US005282559A

United States Patent [19]

Wisser et al.

[11] Patent Number: 5,282,559

[45] Date of Patent: Feb. 1, 1994

[54] HOLSTER WITH FRAME

[75] Inventors: Glenn Wisser, Meridian; Robert E. Pabst, Boise, both of Id.

[73] Assignee: Michaels of Oregon Co., Portland, Oreg.

[21] Appl. No.: 857,639

[22] Filed: Mar. 24, 1992

[51] Int. Cl.[5] ..... F41C 33/02

[52] U.S. Cl. ..... 224/243; 224/193; 224/253; 224/911

[58] Field of Search ..... 224/192, 193, 197, 198, 224/224–226, 228, 235, 236, 238, 240–246, 252, 253, 904, 911, 912

[56] References Cited

U.S. PATENT DOCUMENTS

| | | | |
|---|---|---|---|
| 2,396,118 | 3/1946 | Ohlemeyer | 224/198 |
| 2,410,640 | 11/1946 | Engle | 224/198 |
| 2,765,968 | 10/1956 | Gaylord, Jr. | 224/198 |
| 2,869,768 | 1/1959 | Gainsburgh | 224/198 |
| 3,107,833 | 10/1963 | Vaughn | 224/197 |
| 3,117,708 | 1/1964 | Goldman | 224/198 |
| 3,252,639 | 5/1966 | Sloan | 224/243 |
| 3,630,420 | 12/1971 | Bianchi | 224/243 X |
| 3,923,214 | 12/1975 | Kippen | 224/243 |
| 4,022,361 | 5/1977 | Devlin | 224/911 X |
| 4,079,870 | 3/1978 | Clark | 224/246 |
| 4,084,734 | 4/1978 | Bianchi et al. . | |
| 4,101,060 | 7/1978 | Bianchi et al. | 224/193 X |
| 4,225,067 | 9/1980 | Bianchi et al. | 224/243 |
| 4,253,592 | 3/1981 | Anderson | 224/198 |
| 4,258,871 | 3/1981 | McMahon | 224/192 |
| 4,277,007 | 7/1981 | Bianchi et al. | 224/193 |
| 4,298,150 | 11/1981 | Seldeen | 224/243 |
| 4,325,506 | 4/1982 | Lindell et al. | 224/243 |
| 4,485,947 | 12/1984 | Cook | 224/243 |
| 4,504,001 | 3/1985 | Nichols | 224/198 |
| 4,627,558 | 12/1986 | Binachi et al. | 224/238 |
| 4,645,103 | 2/1987 | Bianchi et al. | 224/243 |
| 4,750,656 | 6/1988 | Bianchi et al. | 224/253 |
| 4,759,483 | 7/1988 | Willoughby | 224/253 |
| 4,815,641 | 3/1989 | Bianchi et al. | 224/238 |
| 4,846,383 | 7/1989 | Gallagher | 224/243 |
| 4,865,238 | 9/1989 | Bianchi | 224/193 |
| 4,925,075 | 5/1990 | Rogers | 224/244 |
| 5,018,653 | 5/1991 | Shoemaker | 224/198 |
| 5,033,663 | 7/1991 | Bianchi et al. | 224/238 |
| 5,150,825 | 9/1992 | Nichols | 224/243 |

OTHER PUBLICATIONS

Michaels of Oregon Co. Catalog 1990, Nov. 1989, pp. 13–15.

Michaels of Oregon Co. Uncle Mike's Sidekick Professional Catalog 1991, Nov. 1990, pp. 1–5.

Michaels of Oregon Co. Catalog, Nov. 1990, pp. 10 and 11.

*Primary Examiner*—J. Casimer Jacyna

*Attorney, Agent, or Firm*—Chernoff, Vilhauer, McClung & Stenzel

[57] ABSTRACT

A holster for handguns, of composite construction including a handgun-holding pocket of laminated flexible material including a layer of a resiliently compressible foam material, with a frame of rigid material attached to the pocket structure, leaving the pocket structure free to move slightly with respect to the frame. A compression band surrounds a portion of the handgun-holding pocket to compress the layer of resiliently compressible material against the surfaces of a handgun held within the holster to provide resistance against withdrawal of the handgun. Anti-twist plates may be provided to resist unauthorized removal of a handgun from the holster, and a security strap and thumb-break are attached to the frame of the holster but not attached directly to the handgun-holding pocket.

16 Claims, 11 Drawing Sheets

Fig. 1
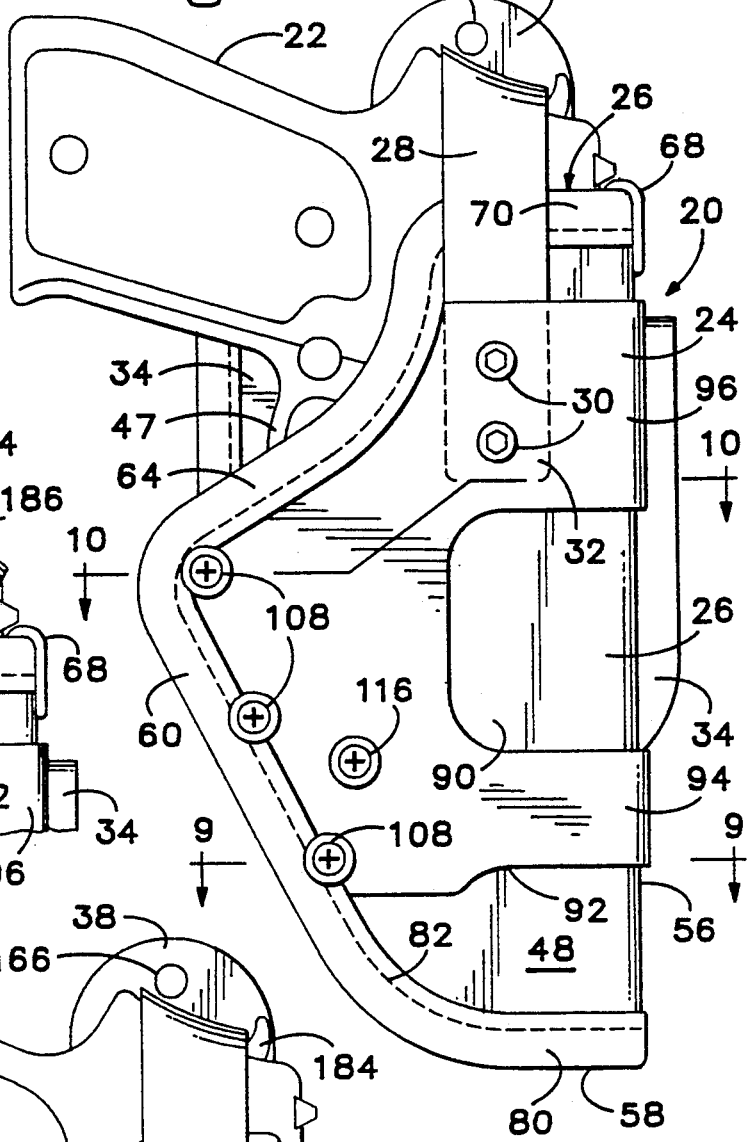
Fig. 15
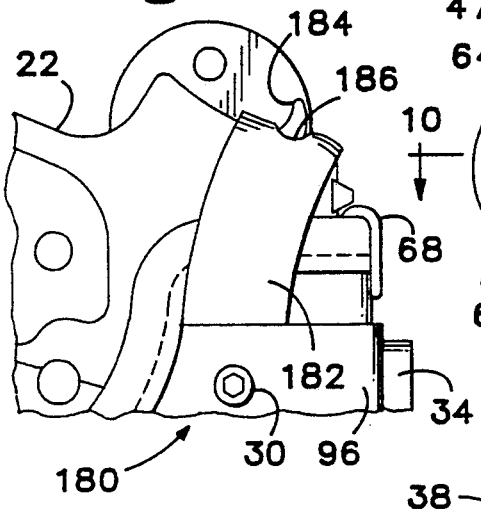
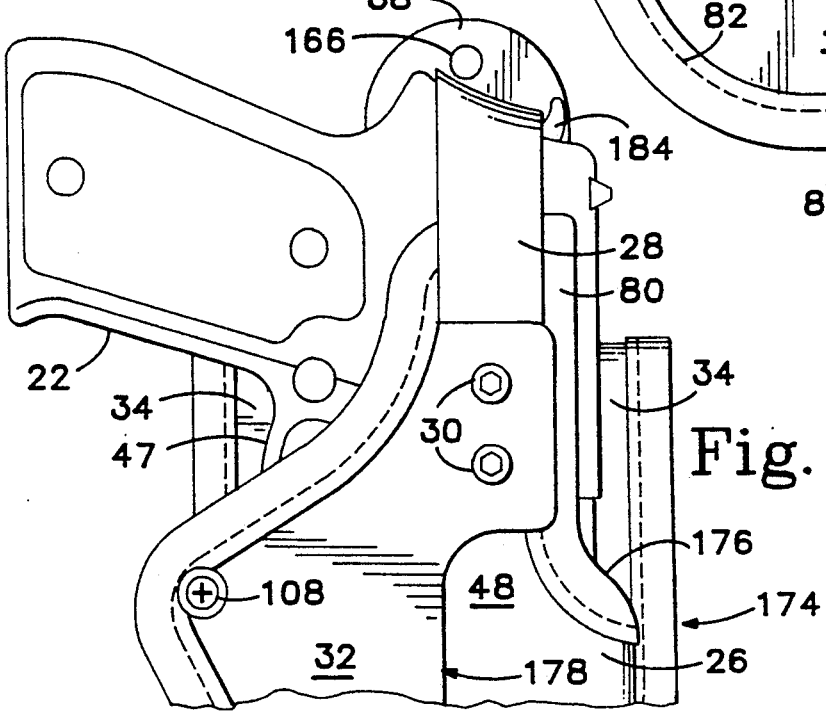
Fig. 14

HOLSTER WITH FRAME

BACKGROUND OF THE INVENTION

The present invention relates to holsters for handguns, and in particular to a holster of composite construction providing improved support, protection, and security for a handgun.

For several years, handgun holsters of composite fabric construction have included a handgun-receiving pocket of laminated fabric structure comprising a strong outer layer, a smooth, relatively soft and nonabrasive inner layer, and an intermediate layer of resiliently compressible material such as closed-cell foam material. While such holsters are adequate for carrying a handgun, their ability to grip a handgun securely enough to resist withdrawal by adversaries and to resist dislodgement of a handgun as a result of sudden or violent movement of the holster's wearer is sometimes less than completely satisfactory, particularly for peace officers whose weapons are subject to attempts at removal by criminals.

Lack of ability of a holster to hold a handgun securely may be partly because of the manner of attaching security straps and belt loops to the holster, resulting in some compression of the laminated material forming the handgun-receiving pocket, so that the resiliently compressible material is not completely free to grip a handgun.

Another factor in the inability to hold a handgun securely enough has been the general shape of handgun holsters, in which a closed bottom end of a holster's handgun-receiving pocket may exert a squeezing force against the muzzle end of a handgun held in such a holster, tending to squeeze the handgun back out of the holster.

Most handguns are asymmetrical, in that latch levers, safety buttons, and other projections may be located on one side of a handgun but not on the opposite side. It is still desirable for a handgun to sit straight in a holster, for the sake of appearance.

It is known that with the laminated fabric holster structure disclosed, for example, in Cook U.S. Pat. No. 4,485,947, different handguns, within a range of sizes, can be accommodated safely in a holster of a single size. Such a holster, however, may not be able to hold a handgun securely enough for some situations, as mentioned above.

In particular, it is desirable for a holster to continue to securely hold a handgun, despite a person other than the wearer twisting the handgun within the holster in an attempt to release a security strap of the holster.

A holster ideally should also provide a certain amount of resistance to removal of a handgun, and should provide such resistance over a reasonable distance as the handgun is being withdrawn from the holster. Once a handgun has been partially removed from a holster beyond such a distance, however, it should thereafter be able to be withdrawn fully with only a small resistance, so long as it is withdrawn in the proper direction.

It has previously been known to provide a stiffening layer supported by sheet metal located on the outside of a handgun holster, as disclosed by Seldeen U.S. Pat. No. 4,298,150. Such a stiffening layer as in the Seldeen holster, however, would not improve the security of a handgun-receiving pocket of fabric construction.

Bianchi et al. U.S. Pat. No. 4,750,656 and Bianchi et al. U.S. Pat. No. 5,033,663 disclose a military holster including a welt which may be of various sizes so that the holster can receive handguns of different sizes. The holster also includes a reinforcement on the exterior of a handgun-receiving pocket of laminated fabric including a layer of a closed cell polyurethane foam.

Lindell et al. U.S. Pat. No. 4,325,506 discloses a leather holster including a reinforcing piece provided to strengthen the structure of the holster.

Sloan U.S. Pat. No. 3,252,639 discloses a holster in which a welt located along a rear margin of the holster is adjustably positioned and then clamped in place by a bolt.

Willoughby U.S. Pat. No. 4,759,483, Nichols U.S. Pat. No. 4,504,001, Anderson U.S. Pat. No. 4,253,592, Goldman U.S. Pat. No. 3,117,708, Gaylord, Jr. U.S. Pat. No. 2,765,968, and Engle U.S. Pat. No. 2,410,640 disclose various attachments of belt loops to holsters or weapons cases to permit adjustments of the position of the belt loops.

Applicants' assignee has made and sold certain prior art handgun holsters in which lower portions of a handgun-receiving pocket are reinforced by a stiffening layer of sheet material, in a holster of fabric construction. Applicants' assignee has also manufactured and sold holsters in which a welt is included along a rear margin of a handgun-receiving pocket of a handgun holster of laminated fabric construction including a layer of resilient foam material.

What has been lacking in the prior art, however, is a handgun holster of fabric construction capable of accommodating handguns of various sizes and configurations, which is adjustable to provide a desired amount of resistance to withdrawal of a weapon from the holster by the wearer of the holster, which is capable of preventing a handgun from dropping from the holster as a result of foreseeable shock or movement, and which resists unwanted removal of a handgun from such a holster by an adversary, whether such withdrawal be attempted from ahead or behind the wearer or by twisting a weapon held in the holster.

SUMMARY OF THE INVENTION

The present invention overcomes the aforementioned shortcomings of previously available handgun holsters and supplies an answer to the above-mentioned need for an improved handgun holster, by providing a handgun holster including a handgun holding pocket of laminated flexible material including at least one layer of a resiliently compressible material, supported by a frame of stiff sheet material extending around portions of an exterior of the handgun holding pocket and connected with the handgun-holding pocket along a rear margin of the pocket. Associated with the frame are a compression band and an adjustable clamping fastener to adjust the amount of compression of the resiliently compressible layer, to provide a controlled amount of resistance to withdrawal of a handgun from the handgun-holding pocket. A security strap and a belt loop are attached to the frame of a holster according to the invention, but are not attached directly to the pocket structure, and the pocket structure is left free to adjust its position with respect to the frame to accommodate the shape and size of a handgun held within the holster.

In a preferred embodiment of the invention a welt of soft material is provided along a rear margin of the pocket, and a sight-engaging strip of a tough soft material is provided in a front portion of the holster to provide additional resistance to withdrawal of a handgun from the holster other than in the intended direction.

In one embodiment of the invention a pair of plates are provided within a rear portion of the handgun-holding pocket, so that one plate is located on each side of a trigger guard of a handgun held within the holster, to resist attempts to rotate a handgun within the handgun-holding pocket.

In one embodiment of the invention the frame is attached to the pocket portion of the holster only by fasteners extending through both the frame and the structure of the pocket of the holster along a rear margin of the holster and by a seam attaching a portion of the body to the frame in the vicinity of a mounting location for a belt loop to support the holster.

It is therefore a principal object of the present invention to provide an improved handgun holster of composite construction for holding a handgun securely.

It is also a principal object of the present invention to provide a holster which grips a handgun held within the holster with an adjustable amount of force within a range of positions of the handgun, yet permits free and smooth withdrawal of the handgun from the holster in a desired direction, once it has been removed beyond such a range of positions.

It is an important feature of the present invention that it includes a supporting frame surrounding portions of a handgun-holding pocket of flexible materials, with the supporting frame attached to the handgun-holding pocket primarily along only rear and upper margin portions and a back side of the holster, while the handgun-holding pocket is free to move with respect to such a frame along a front portion and an outer side of the holster.

It is another feature of the present invention that it provides a thumb-break and security strap combination which are adjustable to allow the holster to hold handguns of various sizes securely within a holster of a single size.

It is a further feature of one embodiment of the present invention that it includes a belt loop which is attached securely to the frame of the holster adjustably and which can be fastened to a holster belt of any of various sizes to retain the holster in a desired position on the holster belt.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is an outer side elevational view of a holster according to the present invention, with a semi-automatic pistol held therein.

FIG. 14 is an outer side elevational view of a portion of a holster which is an alternative embodiment of the present invention.

FIG. 15 is an outer side view of a portion of a holster somewhat similar to that shown in FIG. 1, but including a safety strap of a different type.

DETAILED DESCRIPTION OF THE DRAWINGS

Figure 2:
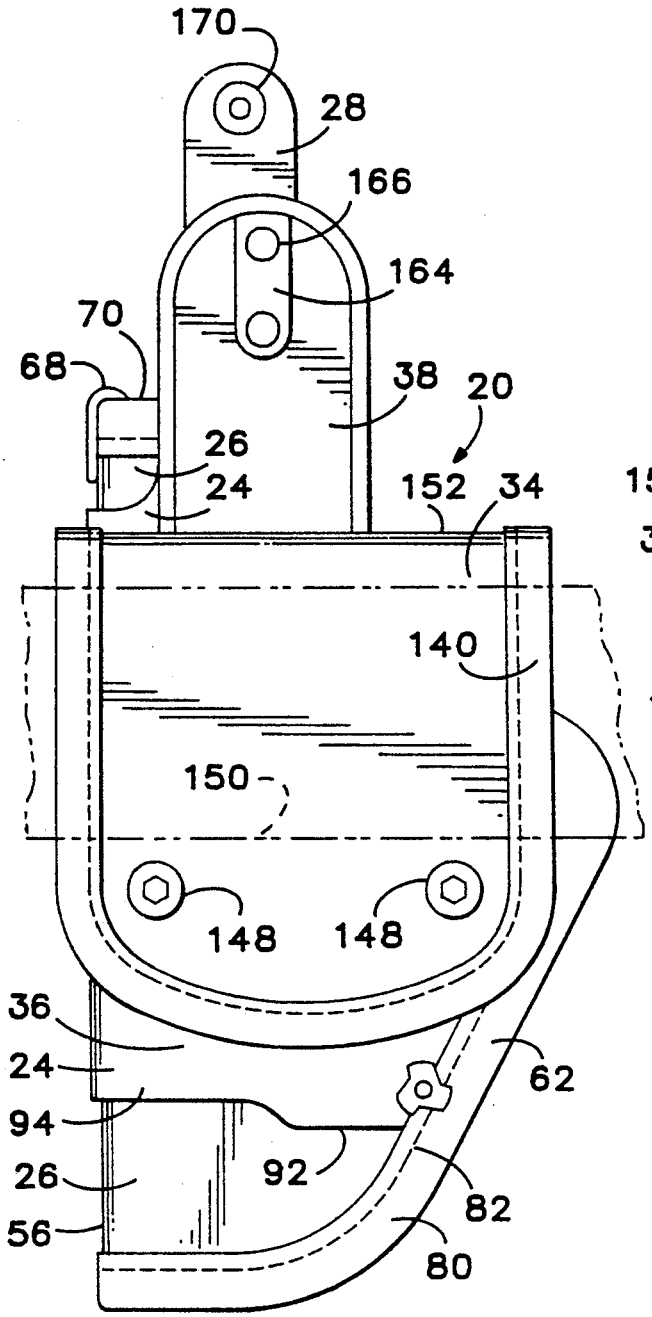
FIG. 2 is a back side elevational view of the holster shown in FIG. 1.
Figure 3:
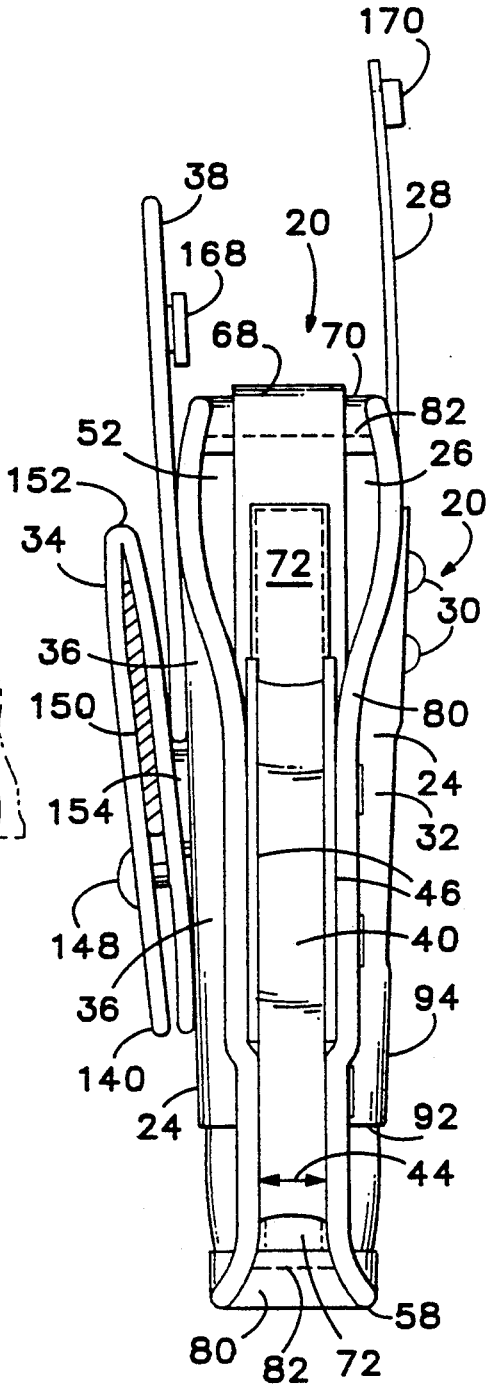
FIG. 3 is a rear elevational view of the holster shown in FIG. 1.
Figure 4:
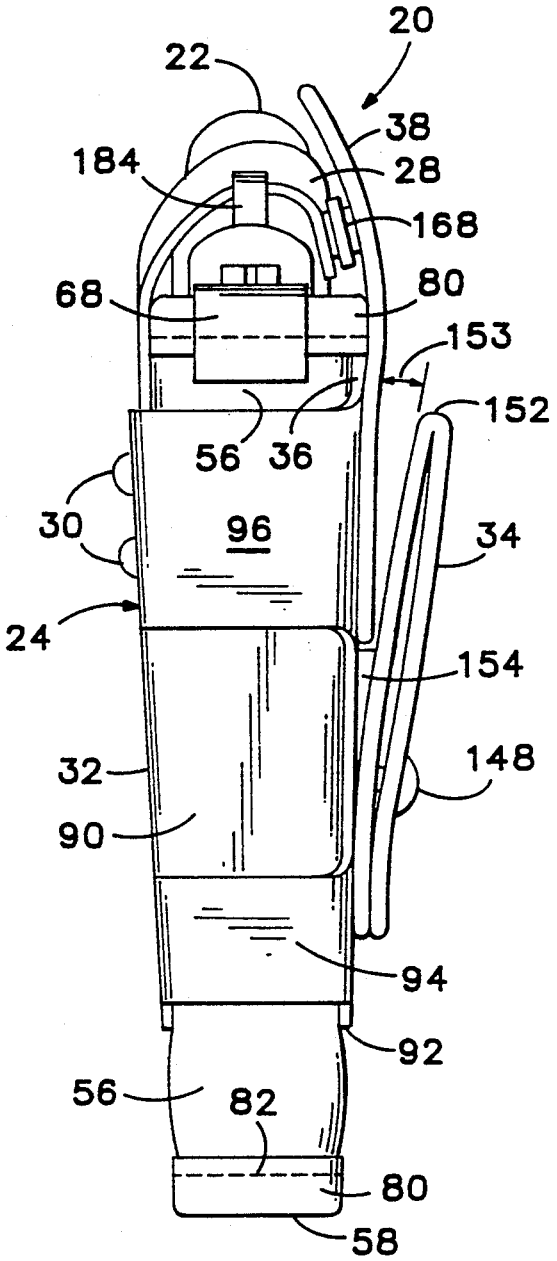
FIG. 4 is a front elevational view of the holster and pistol shown in FIG. 1.
Figure 5:
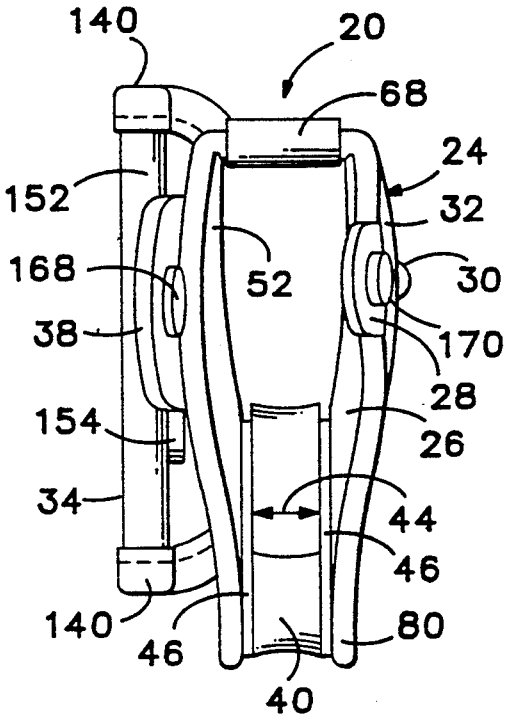
FIG. 5 is a top plan view of the holster shown in FIG. 1.
Figure 6:
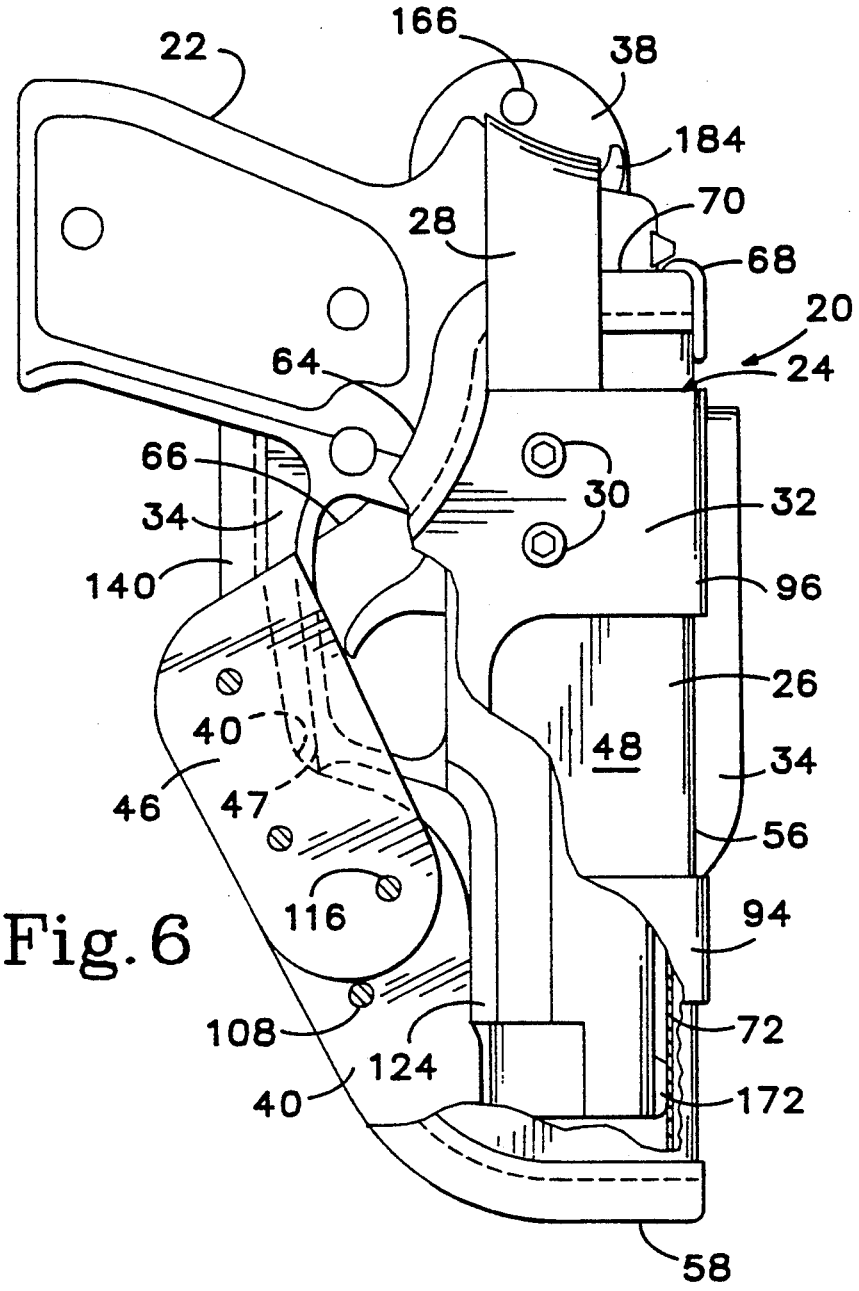
FIG. 6 is a partially cut-away outer side elevational view of the holster and pistol shown in FIG. 1.

Referring first to FIGS. 1–6 of the drawings which form a part of the disclosure herein, a holster 20 holds a pistol 22 securely to resist undesired withdrawal of the pistol, yet permit it to be drawn quickly and smoothly when desired by the wearer. A body portion of the holster 20 includes a frame 24 surrounding and supporting a pocket portion 26. A security strap 28, which may be of a suitably strong and flexible plastic such as a polyurethane, is attached to the frame 24 by fasteners such as screws 30 passing through holes 86 provided in an outer face portion 32 of the frame and mated with corresponding Chicago screws or T-nuts (not shown), extending from the opposite side of the security strap 28. The security strap 28 is thus attached to the frame 24, but not to the pocket 26. A belt loop 34 is attached to a back face 36 of the frame 24, as is a thumb-break 38.

A welt 40 is located along the rear portion of the pocket 26 and has an inner surface 42 forming a part of the interior surface of the pocket 26. The welt 40 may be made of a soft rubber-like material and has a thickness 44 of, for example, one-half inch, although the thickness 44 may differ depending upon the handgun for which a particular holster 20 is intended. A pair of anti-twist plates 46 are located one on each side of the welt 40. The anti-twist plates 46 extend beyond the welt, alongside the trigger guard 47, to resist rotation of the pistol 22 within the pocket 26. The anti-twist plates 46 may be of any suitably strong and stiff material.

The pocket 26 is of a multi-layered fabric structure, including an outer layer 48, an intermediate layer 50, and an inner layer 52. The outer layer 48 is preferably of a sturdy, wear-resistant strong material such as a 1000-denier woven nylon cloth, although the layers 48 and 52 might be of other materials, including leather. The inner layer 52 is preferably a softer, non-abrasive material such as a 400-denier smooth-surfaced nylon pack cloth. The intermediate layer 50 is of a compressible resilient material, preferably a closed-cell foam of a polymeric plastic such as a closed-cell polyethylene foam having a density of 4 pounds per cubic foot and having a thickness 54 of about ¼ inch. The outer layer 48, intermediate layer 50, and inner layer 52 are interconnected by an adhesive (not shown) to join together the layers in a flat configuration. The material of the pocket 26 is later bent along its front portion 56, forming roughly a "U" shape, defining a bottom 58 and respective rear margin portions 60, 62 located respectively adjacent the outer face 32 and back face 36 of the frame 24. Generally, diagonal upper margins 64, 66 of the pocket 26 are defined, associated respectively with the outer face 32 and back face 36 of the frame 24.

A spine member 68, which may be of a woven nylon web material approximately one inch wide, extends along the interior of the front portion 56 of the pocket 26 and is securely attached, as by sewing at the top 70 of the pocket 26, where the tape may overlie the margin of the pocket 26, and at the bottom 58 of the pocket 26. Preferably, a flat strip 72 of a thin, relatively soft polymeric plastic material such as a soft polyurethane, about ¾ inch wide and 0.02 inch thick, is securely sewn to the nylon web portion of the spine member 68 along the margins of the strip 72, as shown best in FIGS. 3 and 11. Preferably, the spine member 68 is also attached to the inner layer 52 along the front portion 56 of the pocket 26 by a layer of an adhesive (not shown).

The frame 24 is of a stiff, tough, yet somewhat flexible thermoplastic material such as a mixture of polyvinylchloride and polyacrylic material available from Kleerdex Company of Mt. Laurel, N.J., under the trademark KYDEX, in the form of a layer about 0.055 inch thick, cut to a shape such as that shown in FIG. 8, where the frame 24 is shown overlying the laminated material of the pocket 26 in a flat configuration.

A binding 80 of a thin, yet strong, fabric such as a nylon sateen ribbon about one inch wide extends around and protectively covers the margins of the material of the pocket 26 and the frame 24. A seam 82 interconnects the margins of the material of the pocket 26 and the frame 24, and also attaches the binding 80 to the pocket 26 and frame 24. The back face portion 36 of the frame defines a pair of holes 84, and the outer face portion 32 of the frame 24 defines a pair of holes 86 which receive the screws 30 to attach the safety strap 28. A hole 88 and a pair of holes 89 spaced above and one to either side of the hole 88 are also provided in the frame 24, to receive fasteners to attach the belt loop 34 to the frame 24. An opening 90 and a bottom margin 92 of the frame define a compression band 94, and an upper band 96 is located above the opening 90.

Figure 8:
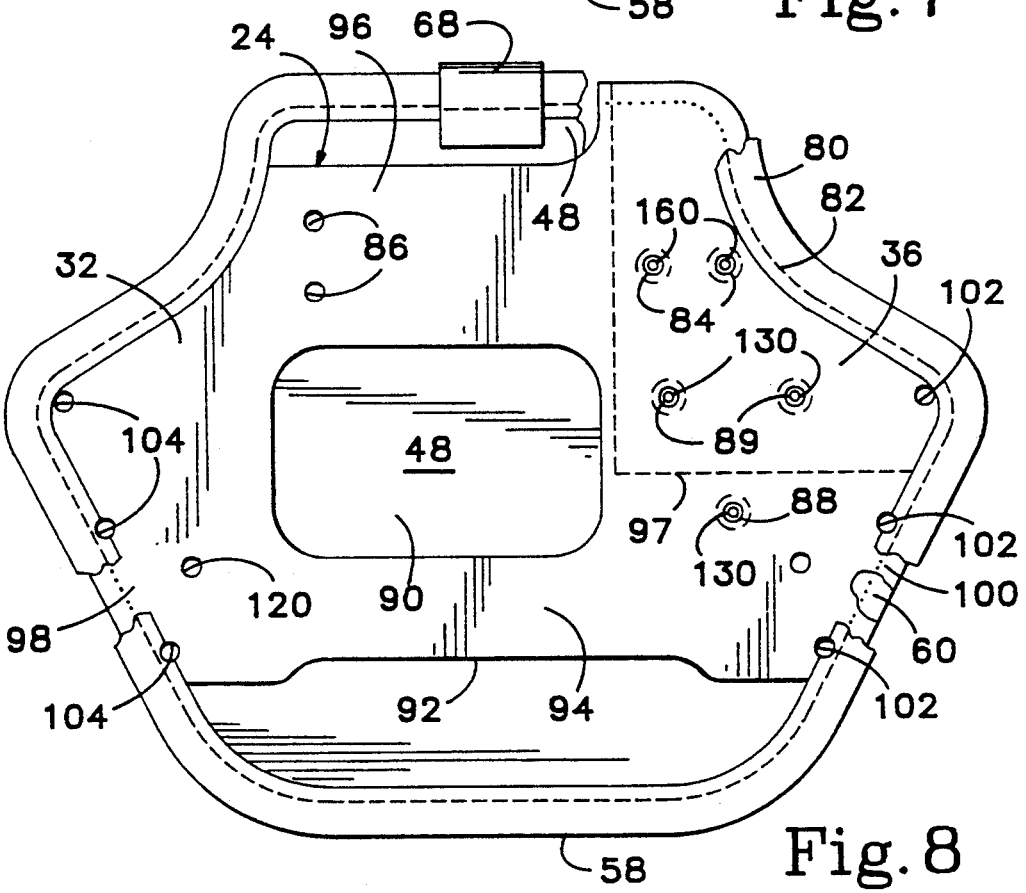
FIG. 8 is a partially cut-away plan view, showing the outer side of the body of a holster shown in FIG. 12 in a partially-assembled, flat form.

A seam 97 of stitching shown in FIG. 8 interconnects the layers 48, 50 and 52 of the pocket and the back face portion 36 of the frame 24 along a generally vertical line and a horizontal line, to provide stability of the pocket 26 with respect to the belt loop 34.

The frame 24 includes rear margins 98 and 100 of the outer face 32 and back face 36, respectively. Three apart-spaced bolt holes 102 extend through both the rear margin portion 100 of the back face of the frame 24 and the corresponding rear margin portion 62 of the back side of the pocket 26. Three correspondingly located bolt holes 104 extend through the rear margin portion 98 of the outer face of the frame and the corresponding rear margin portion 60 of an outer side portion of the pocket 26. Screw fasteners, for example, flat head screws 108 passing through suitable escutcheons and mated in T-nuts 110 interconnect the rear margins 98 and 100, and the rear margins 60, 62. Such fasteners extend through the bolt holes 102, 104 and corresponding bolt holes 112, 114, defined, respectively, by the welt 40 and the anti-twist plates 46, to retain the "U" shape of the pocket 26 as a receptacle for the pistol 22.

Similarly, an adjustable fastener such as a clamp bolt 116, which may also be a flat head screw combined with a T-nut 118, extends through an escutcheon and a clamp bolt hole 120 extending through the outer face and back face portions 32, 36 of the frame 24, through the corresponding portions of the pocket 26, through the anti-twist plates 46, and through the welt 40, in a location spaced further inward with respect to the pocket 26, i.e. forward from the rear margin portions 98, 100 of the frame 24, and aligned vertically with the compression band 94 portion of the frame 24.

Figure 9:
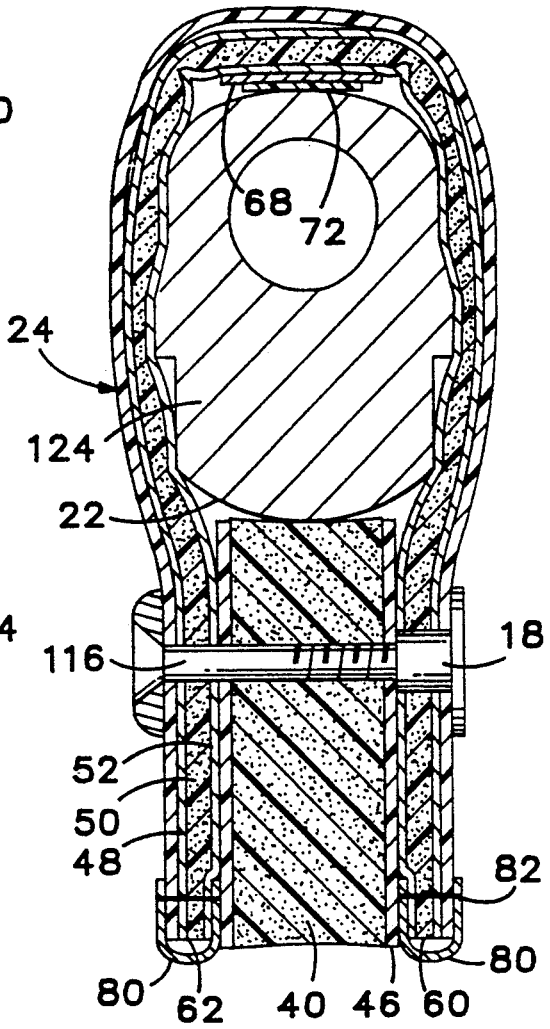
FIG. 9 is a sectional view of the holster and pistol shown in FIG. 1, taken along line 9—9 at an enlarged scale.

The holster 20 is adjustable to hold a particular handgun of the proper range of sizes by adjusting the tension in the clamp bolt 116. A desired amount of pressure can be applied to the compression band 94 to compress the material of the pocket 26, particularly the intermediate layer 50, in the area surrounded by the compression band 94. As shown in FIG. 9, then, with the clamp bolt 116 tightened, the compression band 94 compresses the intermediate layer 50 of the pocket 26 closely against a portion 124 of the slide of the pistol 22, so that the holster 20 snugly grips the pistol 22 when it is in its fully-housed position as shown in FIG. 1.

Figure 10:
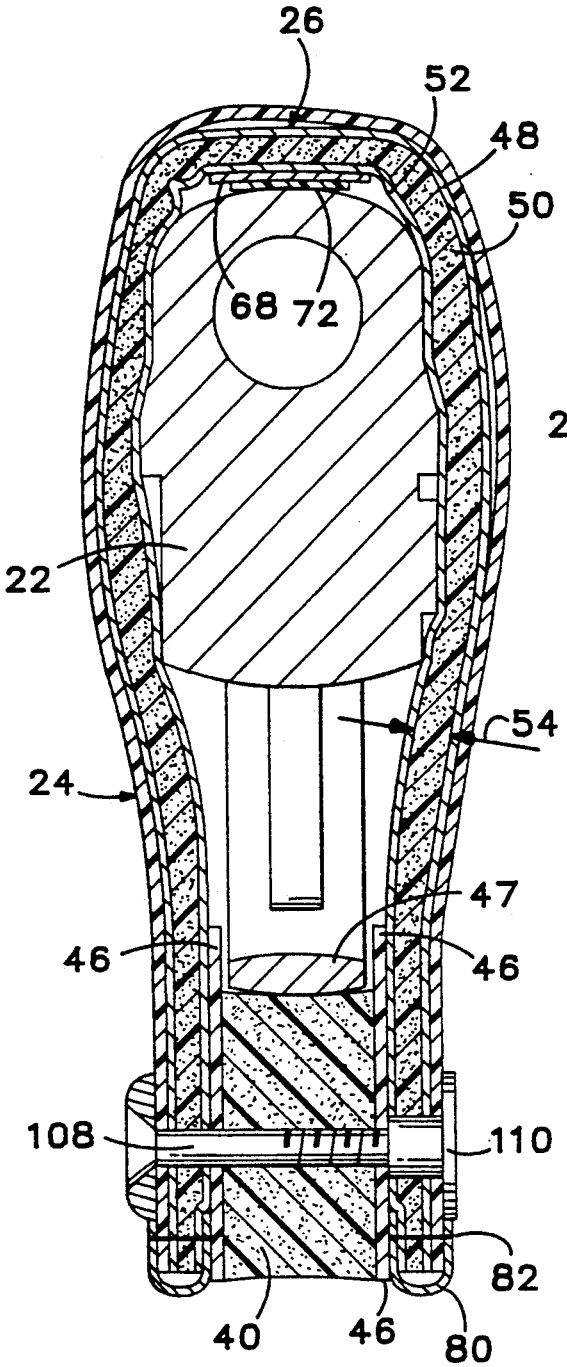
FIG. 10 is a sectional view of the holster and pistol shown in FIG. 1, taken along line 10—10 at an enlarged scale.

At the same time, the upper band 96, not being constrained by a clamp bolt, does not provide so much compression of the pocket 26 against the outer surfaces of the pistol 22, as is shown in FIG. 10. The upper band 96, however, stiffens the holster 20, to resist attempts to rotate a handgun such as the pistol 22 in the pocket 26, without making it difficult to insert the pistol into the holster.

An adhesive may be used to fasten the frame 24 to the outer layer 48 of the pocket 26 adjacent the holes 102, 104 in the rear margins 60, 62, 98, and 100, and on the back face 36 to keep the frame 24 aligned properly with the material of the pocket 26 during assembly of the holster. Except for such adhesive attachment and except for where the margins of the pocket 26 and frame 24 are sewn together, the material of the pocket 26 is left free from the frame 24, particularly in the vicinity of the compression band 94 and the upper band 96. The pocket 26 is thus free to shift with respect to the frame 24 to conform to the outer surfaces of the pistol 22, to fit against the surfaces of the pistol 22, and to accommodate any lack of symmetry in the pistol 22 or another handgun to be carried in the holster 20.

Figure 11:
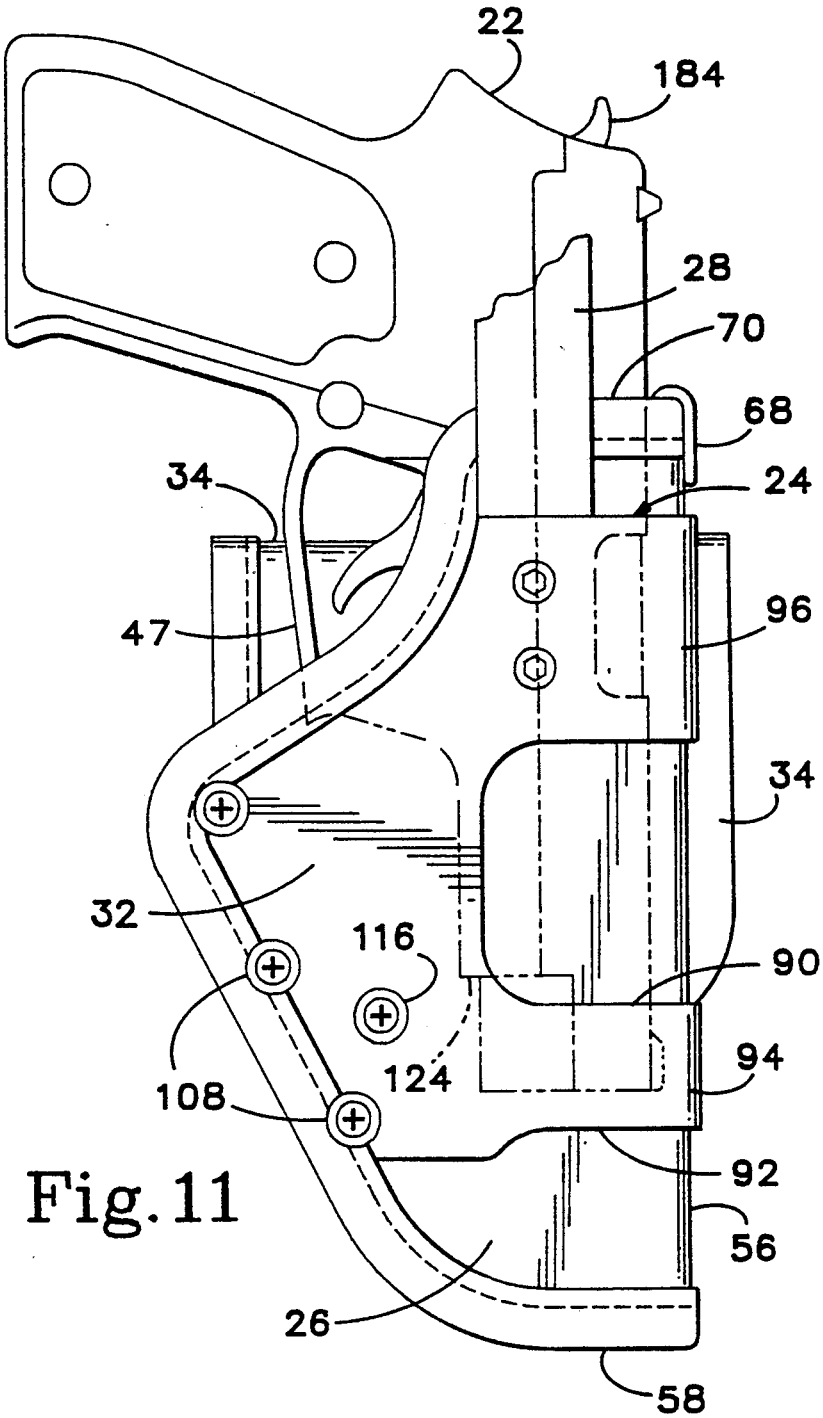
FIG. 11 is an outer side elevational view of the pistol and holster shown in FIG. 1, with the pistol withdrawn partially from its fully-housed position.

The pistol 22 can be withdrawn partially from the holster 20, approximately to the position shown in FIG. 11, with sufficient pressure still being exerted by the compression band 94 and through the compressed laminated material of the pocket 26 against the outer surfaces of the slide of the pistol to significantly resist withdrawal of the pistol 22 from the holster 20. Once the pistol has moved slightly above the position shown in FIG. 11, however, the compression band 94 is aligned with a part of the slide of the pistol 22 which is not so large as the portion 124 encircled by the compression band 94 when the pistol 22 is fully seated in the holster 20. Additionally, the opening 90 allows the material of the pocket 26 to expand and be displaced away from the handgun 22 above the band 94, so that the material of the pocket 26 is then no longer compressed greatly against the surfaces of the slide, and the pistol 22 can thereafter be removed the remainder of the way from the holster smoothly and with little resistance so long as it is withdrawn directly.

This location of the compression band 94 spaced upward from the bottom 58 of the pocket 26 allows the portion 124 of the slide of the pistol 22 to proceed downward into the pocket 26 toward its bottom end 58 with room left for the bottom end 58 of the pocket 26 to expand in response to the presence of the muzzle end of the pistol 22. Thus, the holster 20 does not exert a wedging pressure on the muzzle end of the pistol 22 nor tend to urge the pistol upwardly out of its fully-housed location within the holster 20.

Figure 12:
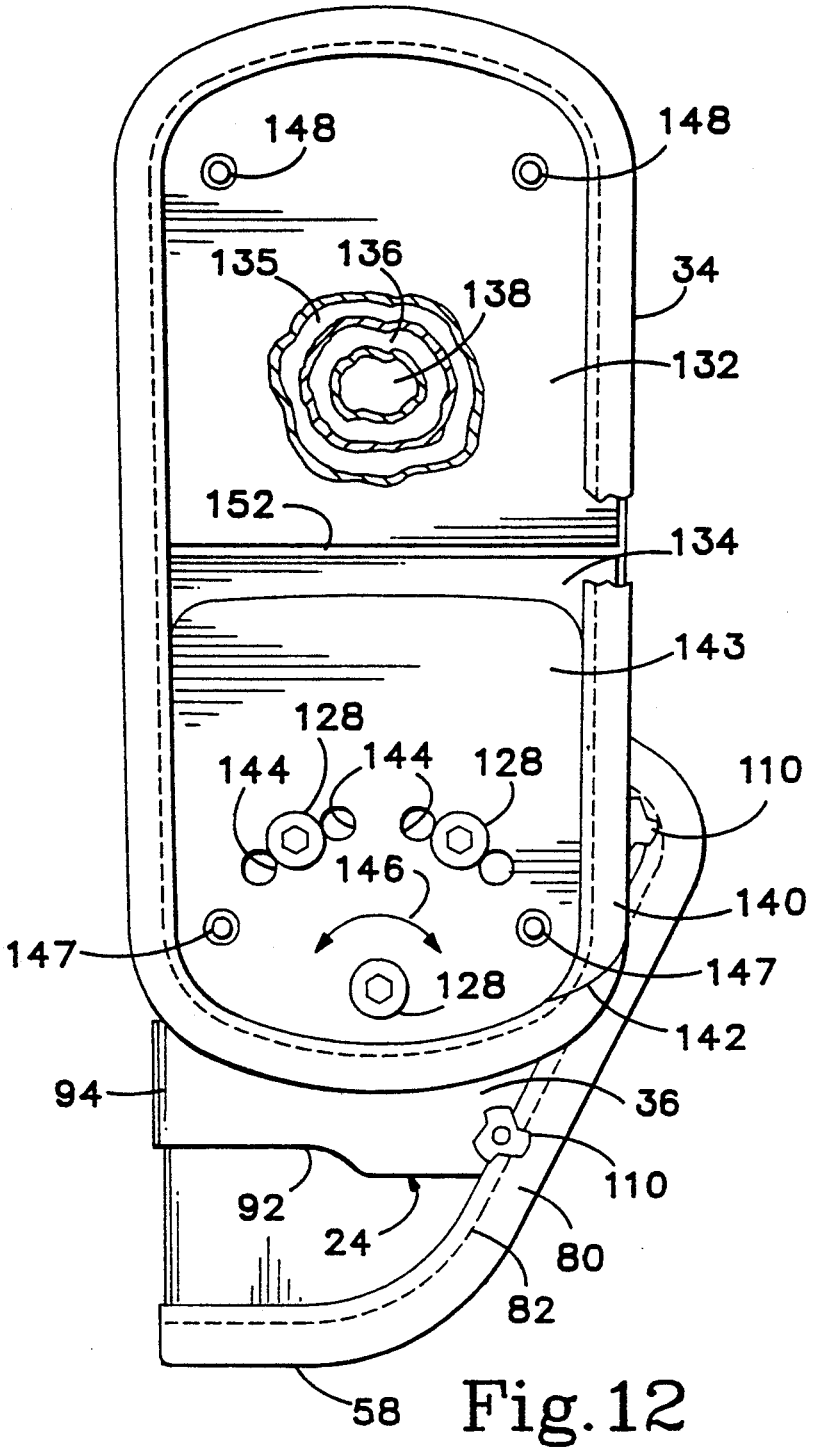
FIG. 12 is a back side elevational view of the holster shown in FIG. 1, showing the belt loop opened and partially cut away.
Figure 13:
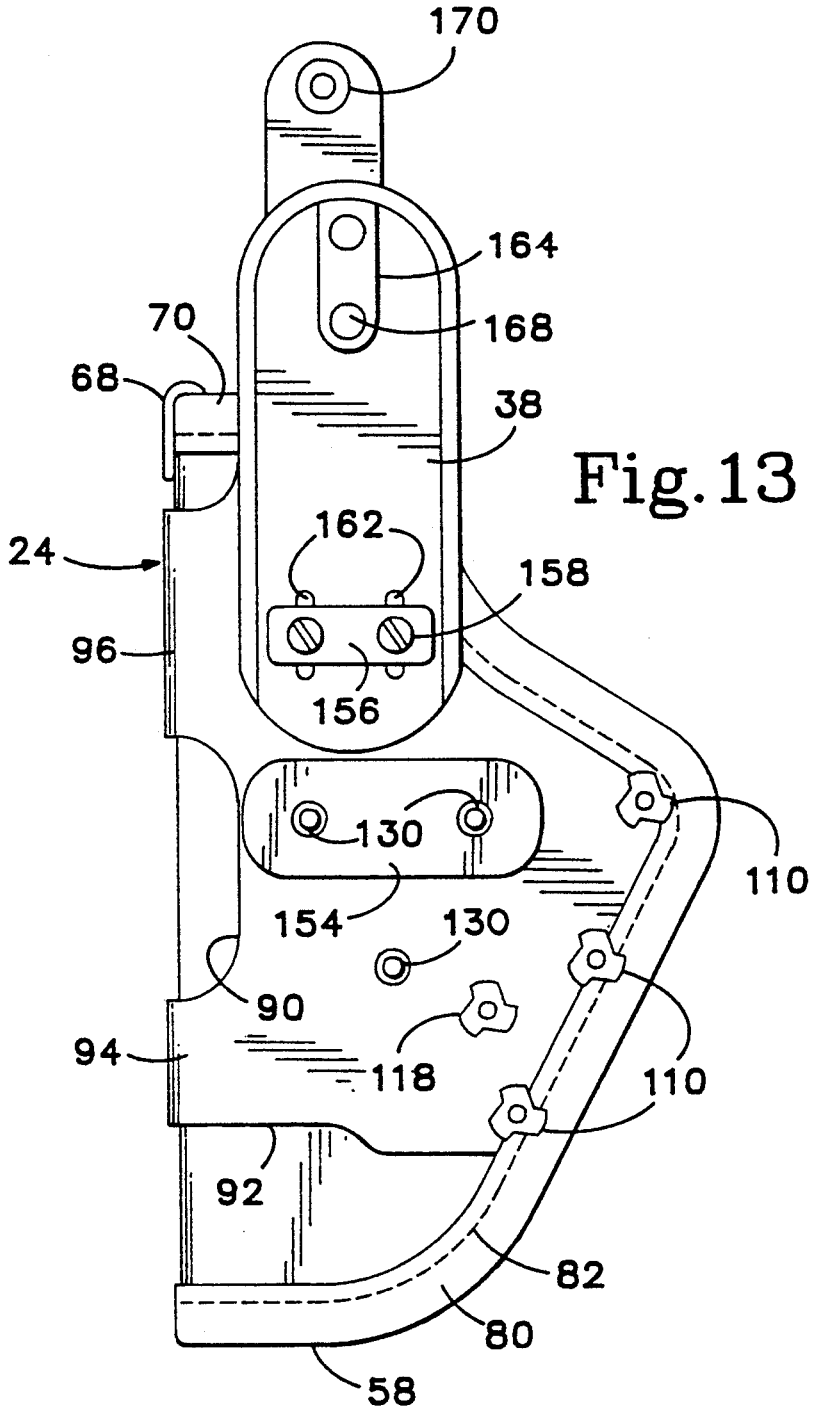
FIG. 13 is a back side elevational view of the holster shown in FIG. 1, with the belt loop removed therefrom.

As may be seen in FIGS. 12 and 13, the belt loop 34 is attached to the back face 36 of the frame 24 by three fasteners, preferably Allen screws 128 extending through holes defined in the inner portion of the belt loop 34 mated in corresponding T-nuts or Chicago screws 130. The belt loop 34 includes a pair of generally planar stiffener plates, of which an outer stiffener 132 is slightly larger than an inner stiffener 134. The stiffeners 132 and 134 may be of plastic sheet material similar to that used as the frame 24. Referring to FIG. 12, attached to each stiffener by an adhesive is a laminate including a layer 135 of light cloth which may be similar to the cloth of the inner layer 52 of the pocket 26, and an adhesively attached layer of a compressible resilient material such as a layer 136 of closed cell foam material similar to that used as the intermediate layer 50 of the pocket 26, although preferably only about half as thick as the intermediate layer 50. Also, adhesively attached to the layer 136 of foam is an outer layer 138 of strong, flexible sheet material which may be cloth the same as that used as the outer layer 48 of the pocket 26.

Extending about both the outer and inner stiffeners 132, 134, the adhered layer 136 of foam, and the layer 138 of cloth, is a binding 140, which may be of material similar to that of the binding 80. The binding 140 is wrapped around and sewn to the peripheral margins of the stiffeners 132, 134 and the adhered layers 135, 136, and 138, covering and protecting the margins against becoming frayed and also providing a soft, rounded surface to avoid abrading the clothing of a person wearing the holster 20. Ends of the binding 140 are preferably overlapped and terminated at a joint 142, located where it will be covered by the outer stiffener 132, as shown in FIG. 2, for better appearance and to avoid abrasion of the wearer's clothing by the joint 142 when the holster is in use.

Holes 144 are provided in the stiffener 134 to permit the belt loop 34 to be pivoted, as indicated by the arrow 146, and held at different angles with respect to the frame 24 of the holster 20 by placing the Allen screws 128 in appropriate ones of the holes 144. Preferably, a doubler plate 143, slightly smaller than the inner stiffener 134, fits alongside the inner stiffener 134, within the area circumscribed by the binding 140 and includes holes corresponding to the holes in the inner stiffener, to receive the Allen screws 128.

A pair of fasteners such as T-nuts 147 extend through corresponding holes in the inner stiffener 134 and the doubler plate 143 to receive fasteners such as Allen screws 148 (FIG. 2) to clamp the outer stiffener 132, and the attached layers 135, 136, and 138 of foam and cloth forming an outer portion of the belt loop 34, to the doubler plate 143 and inner stiffener 134 to tighten the belt loop 34 upon a belt 150 extending through the belt loop 34 as indicated in FIG. 2. A live hinge 152 along the top of the belt loop 34 consists of the layer 136 of foam and the layer 138 of cloth or similar covering material between the stiffeners 132 and 134.

Preferably, the belt loop 34 is manufactured by laminating the stiff plastic material of the stiffeners 132 and 134, to the laminated layers 135, 136, and 138, by use of an adhesive. A piece having the combined shape of both the outer and inner stiffeners 132, 134, is then die-cut from the laminated material including the layers 135, 136, and 138. At the same time, the stiff sheet material of the outer and inner stiffeners 132, 134 is cut only part of the way through its thickness, or scored, along the position of the live hinge 152 and the several holes 144 are cut through the laminated materials. Thereafter, the binding 140 is sewn to the periphery of the laminated materials. Once the binding 140 has been applied, the laminated materials are bent along the scored line of the live hinge 152, to break the outer stiffener 132 apart from the inner stiffener 134, leaving the stiffeners as separate pieces joined by the layers 135, 136, and 138 as the live hinge 152.

When the Allen screws 148 are tightened into the T-nuts 147 the belt loop 34 grips the belt 150 tightly between the doubler 143 and the outer stiffener 132 to prevent movement of the holster 20 along the belt 150, either lengthwise or vertically. The holster 20 is thus securely held on the belt 150 so that a handgun such as the pistol 22 carried in the holster 20 can be withdrawn.

In order to adjust the outward cant angle 153 (FIG. 4) of the holster 20 relative to the belt 150 on which it is worn, a cant-angle spacer 154, shown in FIG. 13, which includes a pair of holes spaced to fit over the upper pair of T-nuts or Chicago screws 130, is placed between the frame 24 of the holster and the upper part of the belt loop 34. By using a spacer 154 having the appropriate thickness, the holster's body may be held so that it is canted outwardly by a cant angle 153 appropriate to give adequate clearance to draw the handgun 22 from the holster 20, according to the requirements of the wearer's physical stature or outer clothing. For example, the spacer 154 may be ⅛ inch, ¼ inch or ⅜ inch thick.

The thumb-break 38 is preferably of a strong, flexible, moldable plastic material such as polyurethane or neoprene, in the form of a strap, which may, for example, be 0.075 inch thick and 1.875 inch wide. It is attached to the frame 24 of the holster by a clamping plate 156 which may be of stiff sheet material similar to that used as the frame 24. The clamping plate 156 is attached to the frame 24 by a pair of fasteners such as screws 158 mated with T-nuts or Chicago screws 160 (FIG. 8) located in the holes 84. The screws 158 extend through slots 162 defined in the thumb-break 38, allowing the position of the thumb-break 38 to be adjusted on the frame 24 to fit various handguns which can be carried in a holster 20 of a particular size.

A stiffener 164 is provided at an upper end of the thumb-break 38, where it is attached by a pair of fasteners. One of these fasteners may be a rivet 166, while the other fastener is a rivet-like attachment for one member 168 of a snap fastener, whose other member 170, preferably the male portion of the snap fastener, is attached to the free end of the safety strap 28. The upper end of the thumb-break 38 thus extends upwardly above the downwardly-curved end of the safety strap 28 when the snap fastener members 168 and 170 are mated to retain the pistol 22 within the holster 20. Pressure against the upper end of the thumb-break 38, because of the stiffener 164, easily separates the snap fastener members 168 and 170 from each other.

Figure 7:
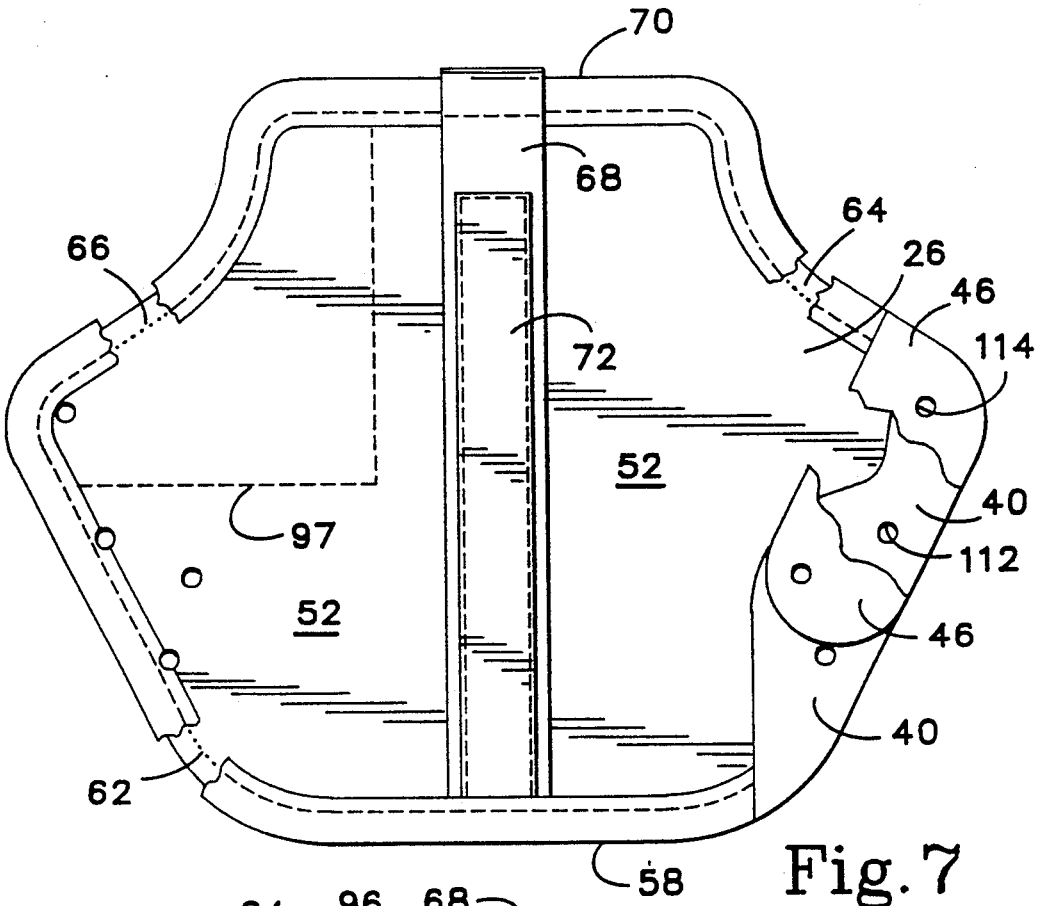
FIG. 7 is a partially cut-away plan view of the body of the holster shown in FIG. 1 in a partially-assembled flat form.

The holster body is preferably assembled by die cutting the laminated materials of the pocket layers 48, 50 and 51, including the various holes, and by separately die cutting the stiff sheet material for the frame 24. The T-nuts or Chicago screws 130 and 160 are inserted into the holes 84, 88 and 89 in the back face portion 32, and the frame 24 is glued to the pocket 26 optionally around the holes 102 and 104, after which the seam 97 is sewn and the binding 80 is put in place and the seam 82 is sewn to connect the frame to the pocket in a flat configuration as shown in FIGS. 7 and 8. The spine member 68 is then glued to the inner layer 52 and sewn to the body at the top 70 and bottom 58 of the pocket 26. Thereafter, the body is bent and the remaining parts are assembled.

The holster 20 of the present invention provides greatly improved security to retain a handgun in such a holster, against forces resulting from the wearer's movements or from actions of an adversary in a combat situation. This security is provided by its resistance to withdrawal provided by the compression band 94 gripping the slide of a handgun such as the pistol 22, and additionally by presence of the strip 72 of tough plastic which is soft enough to be able to catch the sight 172 of the handgun if persons standing behind the butt or grip of the pistol 22 attempt to withdraw it by pulling in a direction more rearward than the intended direction of withdrawal. In such a situation, the soft material of the welt 40 will also provide additional friction against the trigger guard 47 of a handgun 22. In the same sort of a situation, or in the situation wherein a person standing ahead of the holster 20 attempts to withdraw the handgun in a direction too far toward the front 56 of the pocket 26, friction of the trigger guard 47 against the welt 40 also resists unwanted removal of the handgun.

Additionally, the anti-twist plates 46 engage the trigger guard 47 of a handgun 22 to prevent it from being twisted far enough to wrench it free from its secure position within the holster 20.

In a holster 174 which is an alternative embodiment of the present invention, as shown in FIG. 14, the front portion of the holster is open as a channel 176. This permits a handgun 22 held in the holster 174 to be tilted and moved upward to be aimed after a shorter distance of withdrawal from its fully-housed position within the holster. The lower portions (not illustrated) of the holster shown in FIG. 14 are similar to the corresponding portions of the holster 20, but the frame 178 of the holster 174 lacks the upper band 96 of the holster 20.

In FIG. 15, the holster 180 includes a security strap 182 oriented to overlie the hammer 184 of the handgun 22, allowing the hammer spur to protrude through an opening 186 in the security strap 182.

Figure 16:
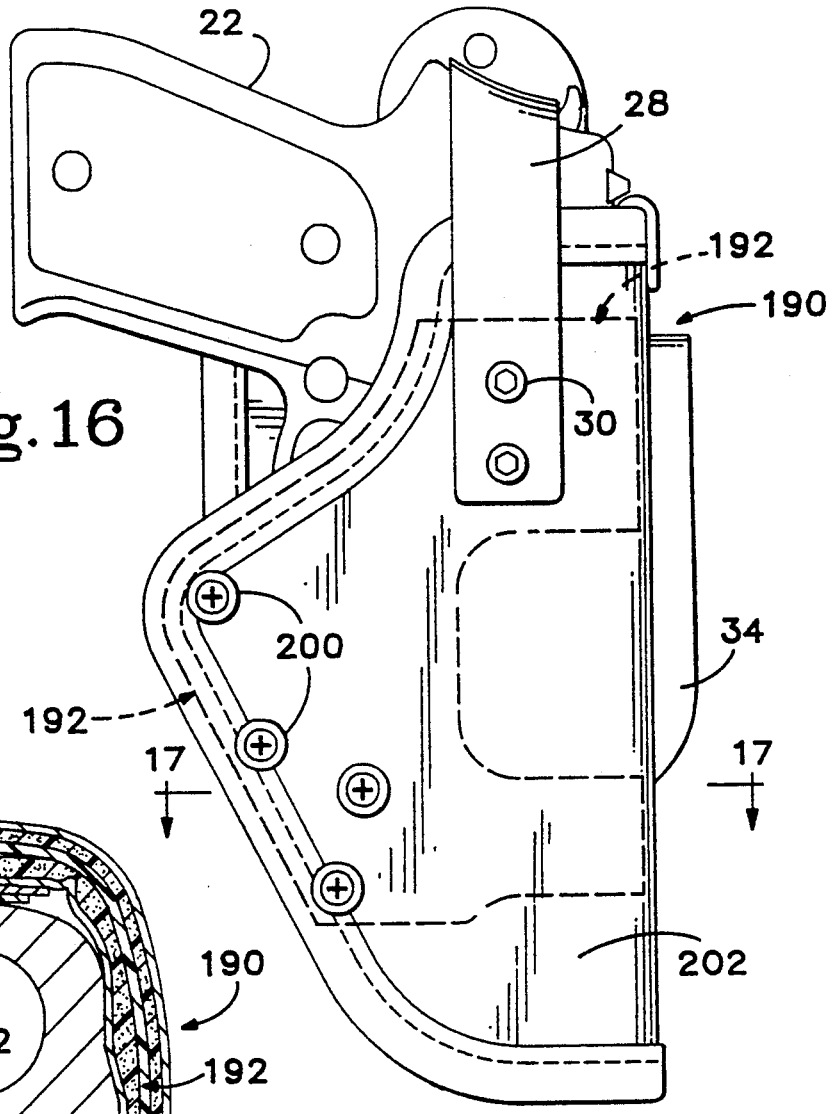
FIG. 16 is a view similar to FIG. 1 showing a holster which is an alternative embodiment of the invention.
Figure 17:
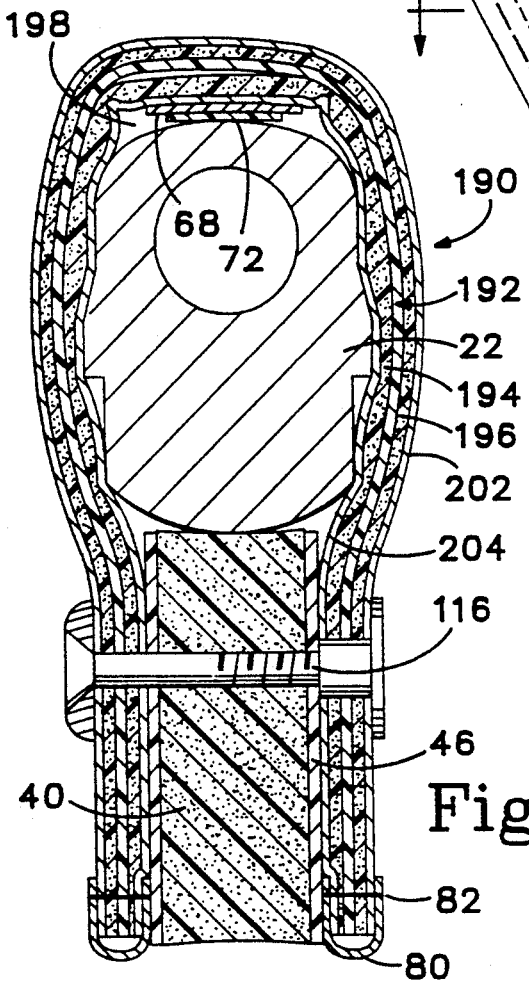
FIG. 17 is a sectional view of the holster shown in FIG. 16, taken along line 17—17.

Referring next to FIGS. 16 and 17, a holster 190 which is an alternative embodiment of the present invention includes a frame 192 of flexible, yet stiff, plastic sheet material similar to that of the frame 24. Instead of being located externally of the entire remainder of the holster, however, the frame 192 is located between a pair of intermediate layers 194, 196 of resiliently compressible material of the pocket 198 of the holster 190. The frame 192 is held in place by the fasteners 200 located along the rear margins of the pocket 198 and corresponding to the Allen screws 106 of the holster 20. The frame 192 is thus covered with a thin layer 196 of compressible foam material and a layer 202 of sturdy fabric similar to the layer 48 of the holster 20, so that the holster 190 has an all-fabric exterior whose appearance may be desired by some. Nevertheless, the compressible intermediate layer 194 and the inner layer 204 of the pocket are free to move as necessary to conform to the handgun to be carried in the pocket 198. The fasteners such as Chicago screws or T-nuts 130, 160 which were located directly in the frame 24 are also located in the frame 192, but will also pass through the outer layers 196 and 202 of the pocket 198 of the holster 190, as will be understood, to attach the thumb-break 38, security strap 28 (which is mounted on the outer surface of the holster), and belt loop 34.

Figure 18:
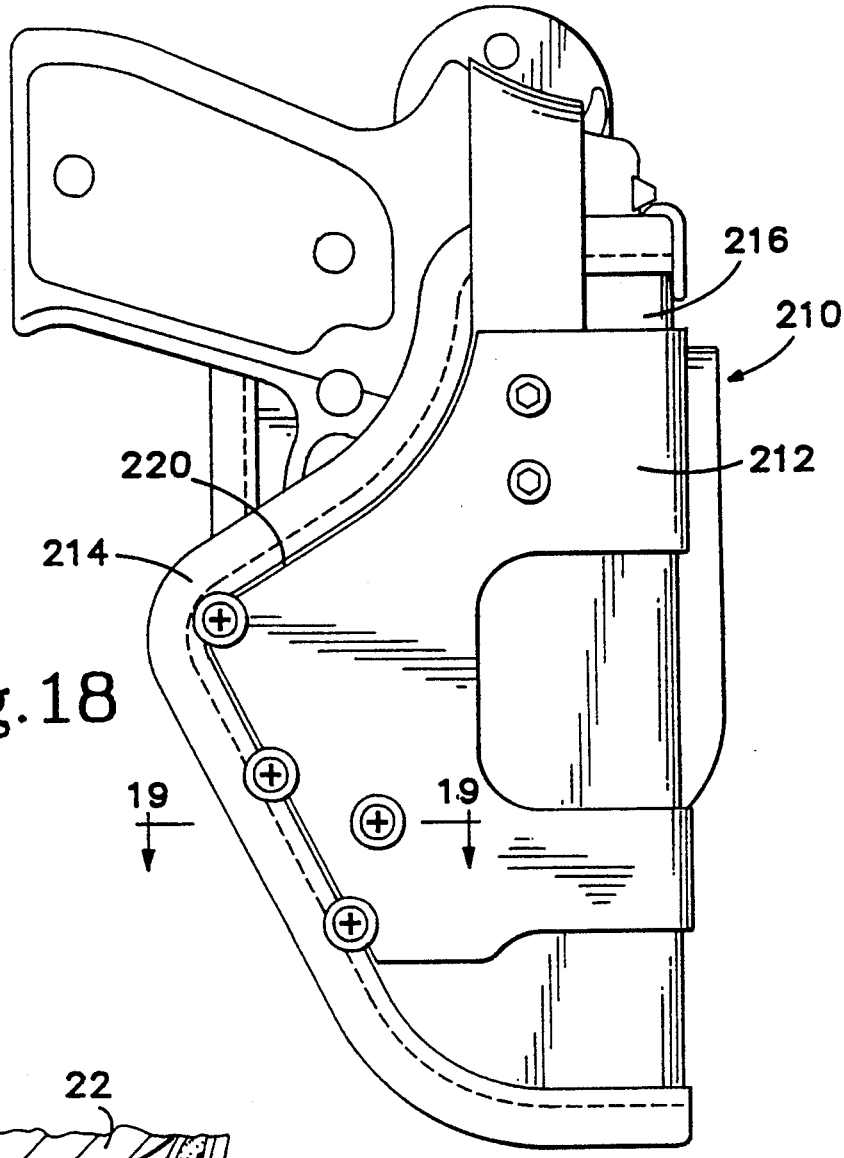
FIG. 18 is a view similar to FIG. 1 showing a holster which is another alternative embodiment of the invention.
Figure 19:
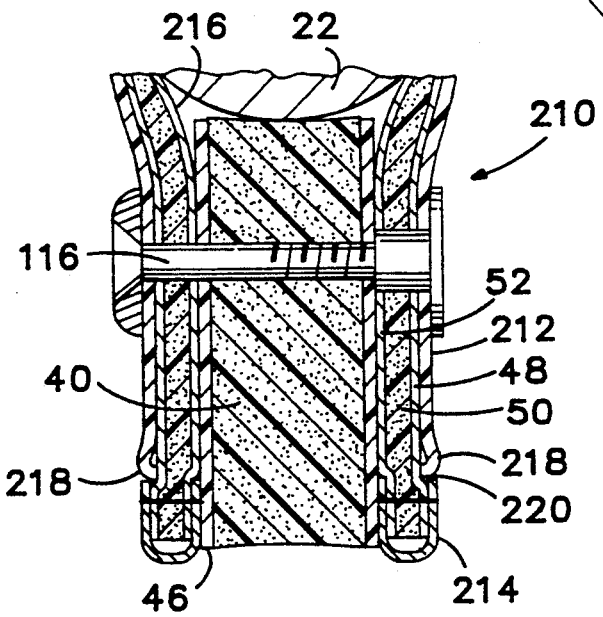
FIG. 19 is a sectional detail view of the holster shown in FIG. 18, taken along line 19—19, at an enlarged scale.

A holster 210 shown in FIGS. 18 and 19 is yet a further embodiment of the present invention, and is in most aspects similar to the holster 20. The frame 212, however, is not sewn together with the binding 214, similar to the binding 80 of the holster 20, which protectively covers the margins of the outer, intermediate, and inner layers 48, 50, and 52 forming the pocket 216. Instead, the frame 212 is slightly smaller than the corresponding frame 24 would be, and includes a margin portion 220 which is curled inward toward the pocket 216. The frame 220 is small enough to fit neatly within the area circumscribed by the binding 214, but is large enough to define all of the various holes defined in the frame 24 for receiving fasteners to mount the thumb-break 38, security strap 28, and belt loop 34.

To enhance the appearance of the holster 210 the margins 220 of the frame 212, at least along the binding 214, are curled inwardly toward the outer layer 48 of material of the pocket 216 to present rounded shoulders 218 instead of sharp edges of the sheet material of the frame 212.

The same number and arrangement of fasteners and other components of the holster are used as in the holster 20, so that the only seam sewn through the pocket 216 and the frame 212 is the seam 97 on the belt loop, or back, side of the pocket 216 of the holster 210, and the pocket 216, like the pocket 26, is free to move sufficiently within the frame 212 to conform to a handgun held in the holster 210 to hold it securely and straight.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A holster for securely holding a handgun, comprising:

(a) a handgun holding pocket including a plurality of overlying layers of flexible material at least one of which is resiliently compressible, said pocket having a front portion and outer and back sides, each of said sides having a respective rear margin and a respective upper margin, and said pocket having a bottom end;

(b) a frame of resiliently stiff sheet material, including an outer face and a back face interconnected by an arcuate compression band, said sheet material extending around said front portion of said pocket and surrounding said pocket in an area spaced upwardly apart from said bottom end thereof, portions of said rear and upper margins of said pocket being attached to said frame but said pocket being free from and movable with respect to said compression band;

(c) adjustable clamping means extending through and interconnecting respective portions of said compression band adjacent said outer and back sides of said frame, for adjustably tightening said compression band around said handgun gripping area of said pocket; and (d) a security strap and a belt loop attached to said frame, said pocket being free from direct attachment of said security strap and said belt loop thereto.

2. The holster of claim 1, including a welt member having a pair of opposite sides separated by a predetermined thickness and extending into said pocket between said rear margins, said holster further including fastener means for holding said outer and back side of said pocket and said outer and back faces of said frame closely against respective opposite sides of said welt.

3. The holster of claim 2, said frame including a respective rear margin of each of said outer and back sides thereof, wherein said fastener means extend through said welt, interconnecting said outer face and said back face of said frame at a plurality of positions along said rear margin thereof.

4. The holster of claim 2 wherein said welt is of a firm yet compressible material and defines a rear interior surface of said pocket.

5. The holster of claim 2, including a pair of anti-twist plates, one of said plates being located on each side of said welt and within said pocket and each of said plates extending beyond said welt toward said front portion of said pocket.

6. The holster of claim 2, including a strip of soft plastic located within said pocket and extending along said front portion thereof longitudinally from said top margin toward said bottom end.

7. The holster of claim 2, including a thumb-break member adjustably fastened to said back side of said frame thereof in an adjustable position thereon.

8. The holster of claim 2 wherein said clamping means includes a clamp bolt located inward from said rear margin of said pocket and extending through a portion of said welt, whereby tightening of said clamp bolt urges said compression band against said layers of flexible material of said pocket and against said welt.

9. The holster of claim 1, said frame further including an upper band extending arcuately about said front portion of said pocket, interconnecting said outer face and said back face, said frame defining an opening between said upper band and said compression band wherein some of said front portion and said outer face of said pocket are exposed outwardly therealong.

10. The holster of claim 9 wherein said pocket is free from adherence to said upper band and said compression band.

11. The holster of claim 1 wherein said pocket is free from attachment of fasteners and seams compressing said layers thereof toward one another, except proximate said margins thereof and said back side thereof.

12. The holster of claim 1, including a cant-out spacer located between said back face of said frame and said belt loop.

13. The holster of claim 1 wherein said belt loop includes a pair of oppositely-located stiffeners interconnected along an upper margin of said belt loop by a hinge of flexible material.

14. The holster of claim 13, said belt loop including an outer layer of a strong, flexible material, an intermediate layer of a resiliently compressible foam material, a further layer of a strong flexible material, and inner members including said stiffeners, all of said outer layer, intermediate layer, further layer and stiffeners being interconnected with one another by a binding extending around said belt loop and attached thereto by stitching extending through all of said layers and said binding.

15. The holster of claim 1 wherein said belt loop is attached to said back side of said frame by a plurality of fasteners, one of said fasteners being a pivot and at least one of said fasteners engaging said belt loop in a selected one of a plurality of different holes provided in one of said stiffeners of said belt loop in position to be used to hold said belt loop in a selected position with respect to said frame.

16. The holster of claim 15, said belt loop including a doubler plate adjacent one of said stiffeners thereof.

* * * * *